US009470447B2

(12) United States Patent
Lee et al.

(10) Patent No.: US 9,470,447 B2
(45) Date of Patent: Oct. 18, 2016

(54) ICE MAKER AND WATER PURIFIER HAVING THE SAME

(71) Applicant: WOONGJIN COWAY CO. LTD., Choongcheongnam-do (KR)

(72) Inventors: Jong-Han Lee, Seoul (KR); Jung-Chul Park, Seoul (KR); Hee-Do Jung, Seoul (KR); Hyun-Woo Lee, Seoul (KR)

(73) Assignee: WOONGJIN COWAY CO. LTD., Choongcheongnam-do (KR)

( * ) Notice: Subject to any disclaimer, the term of this patent is extended or adjusted under 35 U.S.C. 154(b) by 0 days.

(21) Appl. No.: 14/610,281

(22) Filed: Jan. 30, 2015

(65) Prior Publication Data

US 2015/0128634 A1 May 14, 2015

Related U.S. Application Data

(62) Division of application No. 12/989,328, filed as application No. PCT/KR2009/001649 on Mar. 31, 2009, now abandoned.

(30) Foreign Application Priority Data

Apr. 22, 2008 (KR) ..... 10-2008-0037450

(51) Int. Cl.
*F25C 1/00* (2006.01)
*F25C 5/18* (2006.01)
(Continued)

(52) U.S. Cl.
CPC ..... *F25C 1/04* (2013.01); *F25C 1/225* (2013.01); *F25C 2305/022* (2013.01)

(58) Field of Classification Search
CPC ..... F25C 1/08; F25C 1/10; F25C 2400/04; F25C 2400/14; F25C 2700/14; F25C 2305/022; F25C 1/00; F25C 5/00; F25C 1/22; F25C 1/225
USPC ..... 62/347, 344, 348, 66, 67, 353
See application file for complete search history.

(56) References Cited

U.S. PATENT DOCUMENTS 5,425,243 A 6/1995 Sanuki et al.
7,010,933 B2 3/2006 Ishitomi et al.
(Continued)

FOREIGN PATENT DOCUMENTS

CN 2521574 11/2002
CN 1952538 4/2007
(Continued)

OTHER PUBLICATIONS

Machine translation of Wessa, DE 3216597.*

*Primary Examiner* — Ryan J Walters
*Assistant Examiner* — Joseph Trpisovsky
(74) *Attorney, Agent, or Firm* — Roberts & Roberts, LLP

(57) ABSTRACT

An ice maker and a water purifier capable of making ice using two water trays. The water purifier having an ice maker includes a water tray member comprising an ice-making water tray holding ice-making raw water to make ice using an ice-making unit, and an auxiliary water tray holding ice-making raw water remaining in the ice-making water tray in the course of cooling the ice-making raw water by means of the ice-making unit and removing the ice-making raw water from the ice-making water tray; an ice reservoir storing ice made in the ice-making unit; a cold water storage tank cooling water held therein using the ice made in the ice-making unit; and a guide member guiding the ice made in the ice-making unit so that the ice is selectively fed to either the ice reservoir or the cold water storage tank.

4 Claims, 8 Drawing Sheets

(51) Int. Cl.
*F25C 1/04* (2006.01)
*F25C 1/22* (2006.01)

(56) References Cited

U.S. PATENT DOCUMENTS

| | | | |
|---|---|---|---|
| 7,201,014 | B2 | 4/2007 | Hornung |
| 7,201,015 | B2 | 4/2007 | Feldman et al. |
| 7,681,406 | B2 | 3/2010 | Cushman et al. |
| 2004/0107721 | A1 | 6/2004 | Choi et al. |
| 2007/0089451 | A1 | 4/2007 | Lee |

FOREIGN PATENT DOCUMENTS

| | | | |
|---|---|---|---|
| DE | 3216597 | | 11/1983 |
| JP | 2000-213837 | A | 8/2000 |
| JP | 2002-333243 | A | 11/2002 |
| JP | 2003-269828 | A | 9/2003 |
| JP | 2007-089451 | A | 4/2007 |
| KR | 10-0729962 | A | 6/2007 |
| KR | 2007-104093 | A | 10/2007 |

* cited by examiner

ICE MAKER AND WATER PURIFIER HAVING THE SAME

CROSS REFERENCE TO RELATED APPLICATIONS

This application is a division of U.S. patent application Ser. No. 12/989,328 filed Oct. 22, 2010 which was a U.S. national phase entry of PCT/KR2009/001649 filed Mar. 31, 2009, and claims priority to Korean patent application serial number 10-2008-0037450 filed Apr. 22, 2008.

TECHNICAL FIELD

The present invention relates to an ice maker comprising an ice-making unit and a water purifier having the ice maker, and more particularly, to an ice maker capable of effectively making ice using two water trays and a water purifier having the same.

BACKGROUND ART

In general, an ice maker is an apparatus that make ice using an ice-making unit and a water purifier may include this ice maker.

This water purifier having an ice maker is an apparatus that purifies raw water such as tap water and dispenses the purified water, cold water and/or hot water, and ice to users. In general, the water purifier having an ice maker includes a filter unit for purifying raw water, a purified water storage tank for storing purified water, a cold water storage tank for cooling and storing purified water, and an ice-making unit for making ice. Also, the water purifier may further include a hot water storage tank for heating and storing purified water.

These ice maker and water purifier having the same are usually provided with an ice-making water tray holding ice-making raw water from the purified water storage tank, etc. and functions to cool the ice-making raw water held in the water tray in order to make ice.

However, since a temperature of the ice-making raw water held in the ice-making water tray is close to a room temperature, the ice-making raw water should be cooled to make ice. However, this cooling process has problems in that a lot of power and time are required to cool the ice-making raw water.

DISCLOSURE OF INVENTION

Technical Problem

The present invention is designed to solve the problems of the prior art, and therefore it is an object of the present invention to provide an ice maker and a water purifier having the same capable of effectively making ice using low-temperature ice-making raw water.

It is another object of the present invention to provide a water purifier having an ice maker capable of effectively maintaining a temperature of a cold water storage tank using only one cooling unit.

Technical Solution

According to an aspect of the present invention, there is provided an ice maker comprising an ice-making water tray holding ice-making raw water to make ice using an ice-making unit; and an auxiliary water tray holding ice-making raw water remaining in the ice-making water tray in the course of cooling the ice-making raw water by means of the ice-making unit and removing the ice-making raw water from the ice-making water tray.

In this case, the auxiliary water tray may be coupled to one side of the ice-making water tray.

Also, the auxiliary water tray may be installed in one side of the ice-making water tray so that the auxiliary water tray can be fixed and maintained in the ice-making water tray.

In addition, the ice-making raw water remaining in the ice-making water tray may be transferred to the auxiliary water tray as the ice-making water tray rotates toward an ice separation position by means of a water tray rotating means, and the residual raw water transferred to the auxiliary water tray may be fed back to the ice-making water tray as the ice-making water tray returns to an ice-making position by means of the water tray rotating means.

Additionally, a rotation angle of the ice-making water tray rotated by the water tray rotating means may be in a range of 80 to 120 degrees when the ice-making water tray moves from the ice-making position to the ice separation position.

Also, the ice maker may further comprise a guide grill provided with a water inlet having a smaller diameter than that of the ice so that the ice-making raw water remaining in the ice-making water tray flows in the auxiliary water tray, the guide grill being mounted on the auxiliary water tray.

Additionally, the ice-making water tray and the auxiliary water tray may rotate toward an ice separation position by means of the water tray rotating means, and the guide grill may be inclined downwards along a direction where the ice falls down at the ice separation position.

Furthermore, the ice-making unit may include an evaporator installed to be immersed in ice-making raw water held in the ice-making water tray.

According to another aspect of the present invention, there is provided a water purifier having an ice maker including a water tray member including an ice-making water tray holding ice-making raw water to make ice using an ice-making unit, and an auxiliary water tray holding ice-making raw water remaining in the ice-making water tray in the course of cooling the ice-making raw water by means of the ice-making unit and removing the ice-making raw water from the ice-making water tray; an ice reservoir storing ice made in the ice-making unit; a cold water storage tank cooling water held therein using the ice made in the ice-making unit; and a guide member guiding the ice made in the ice-making unit so that the ice is selectively fed to either the ice reservoir or the cold water storage tank.

In this case, the water tray member may further include a guide grill provided with a water inlet having a smaller diameter than that of the ice so that the ice-making raw water remaining in the ice-making water tray flows in the auxiliary water tray, the guide grill being mounted on the auxiliary water tray.

Also, the guide member may rotate between a first position to which the ice is guided so that the ice is fed to the ice reservoir, and a second position to which the cold water is guided so that the ice is fed to the cold water storage tank.

Furthermore, the water purifier having an ice maker may further include a controller controlling an amount of ice being fed to the cold water storage tank according to the temperature of water in the cold water storage tank.

Advantageous Effects

As described above, the ice maker and the water purifier having the same according to one exemplary embodiment of the present invention may be useful to improve the ice-making efficiency since residual cooling water cooled in the ice-making water tray is collected in the auxiliary water tray, and re-used to make ice.

Also, the ice maker and the water purifier having the same according to one exemplary embodiment of the present invention may be useful to effectively make ice since cooling water remaining in the ice-making water tray is used to make ice, although a temperature of the cold water storage tank is increased due to the dispensing of excessive cold water.

In addition, the water purifier having an ice maker according to one exemplary embodiment of the present invention may have simple configuration of a cooling cycle since the ice made in the ice-making unit is used to cool water held in the cold water storage tank and therefore a separate evaporator is not required to cool the cold water storage tank.

Additionally, the water purifier having an ice maker according to one exemplary embodiment of the present invention may be useful to provide a simple ice-feeding operation since the ice is selectively fed to the ice reservoir and the cold water storage tank by rotation of a guide member.

Furthermore, the water purifier having an ice maker according to one exemplary embodiment of the present invention may be useful to maintain a temperature of water in the cold water storage tank to a suitable temperature level since the water purifier includes a controller controlling an amount of ice being fed to the cold water storage tank according to the temperature of water in the cold water storage tank.

BEST MODE FOR CARRYING OUT THE INVENTION

Hereinafter, exemplary embodiments of the present invention will be described in more detail with reference to the accompanying drawings.

Figure 1:
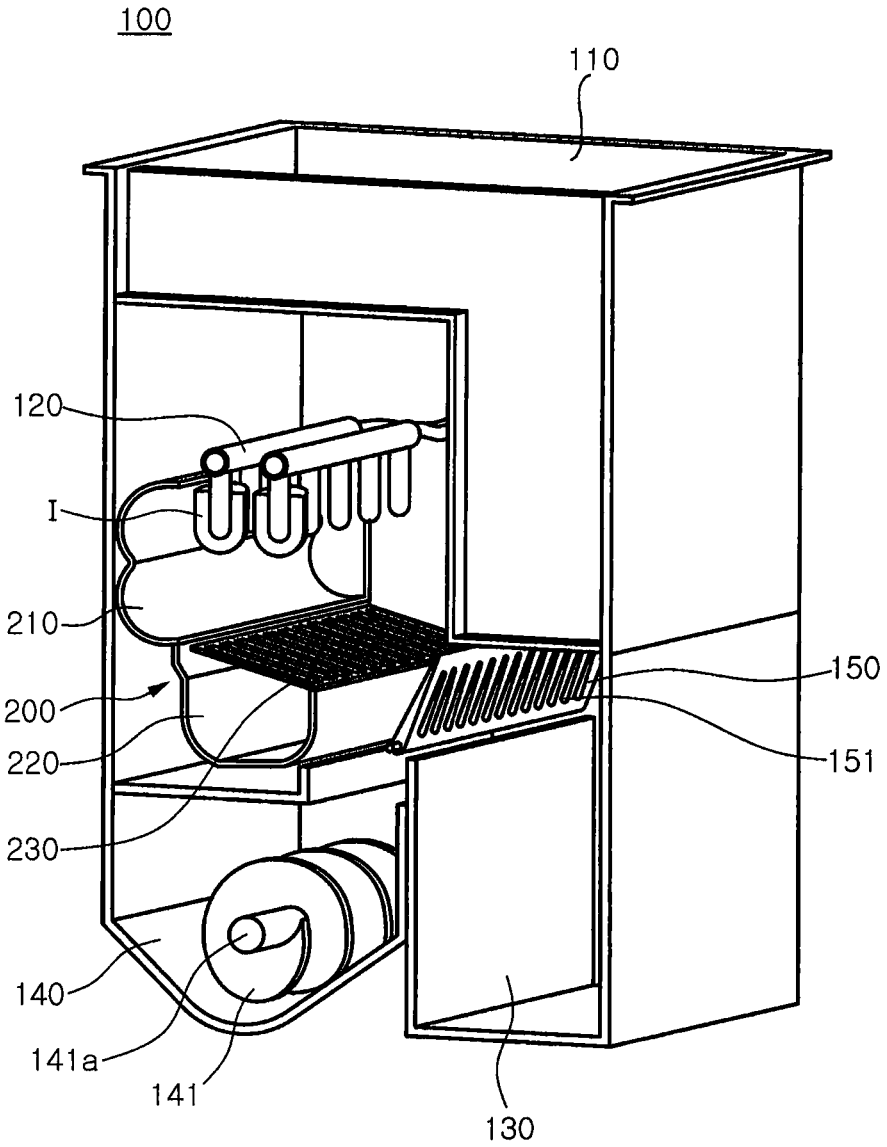
FIG. 1 is a partially exploded perspective view illustrating a water purifier having an ice maker according to one exemplary embodiment of the present invention.
Figure 2:
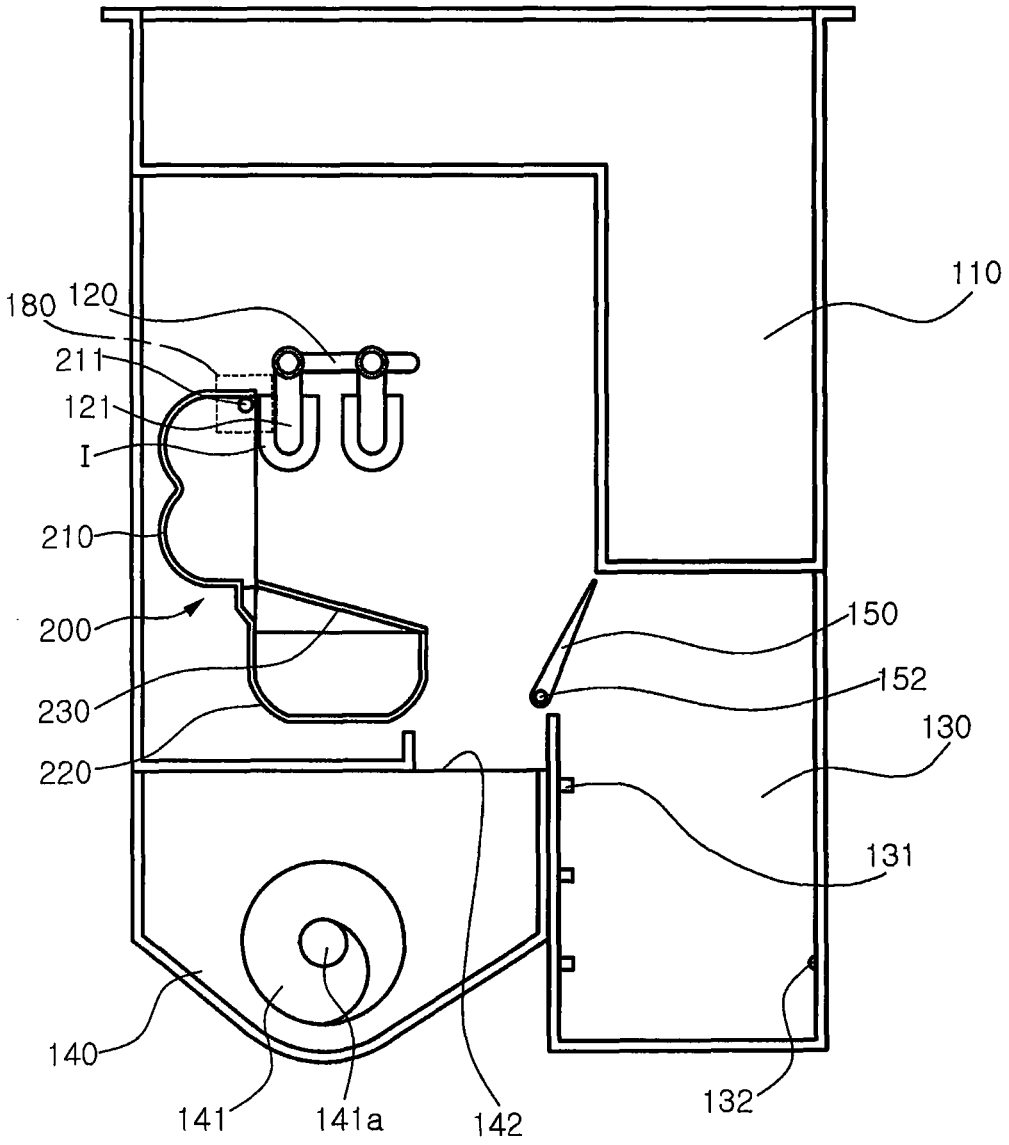
FIG. 2 is a schematic view illustrating an inner configuration of the water purifier having an ice maker as shown in FIG. 1.
Figure 3:
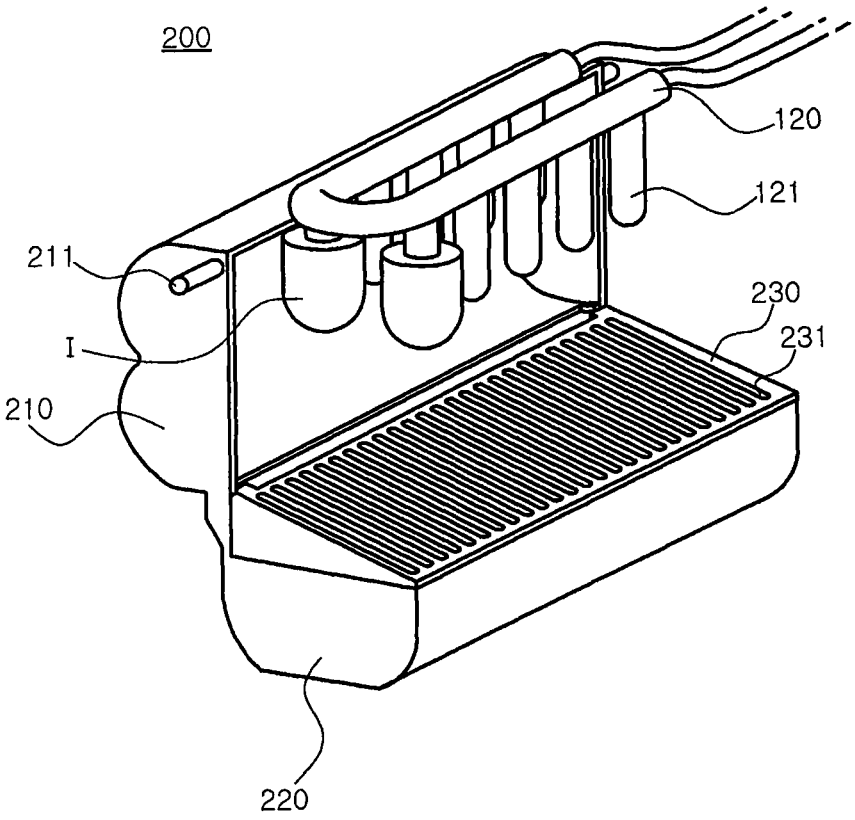
FIG. 3 is a perspective view illustrating a water tray member provided in the water purifier having an ice maker according to one exemplary embodiment of the present invention.
Figure 4:
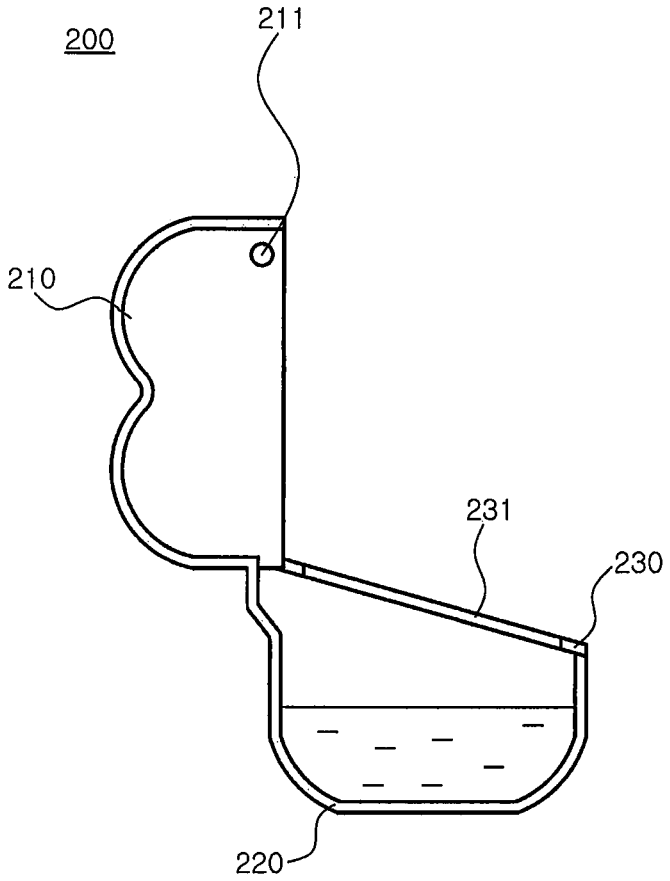
FIG. 4 is a cross-sectional view illustrating a water tray member as shown in FIG. 3.
Figure 5:
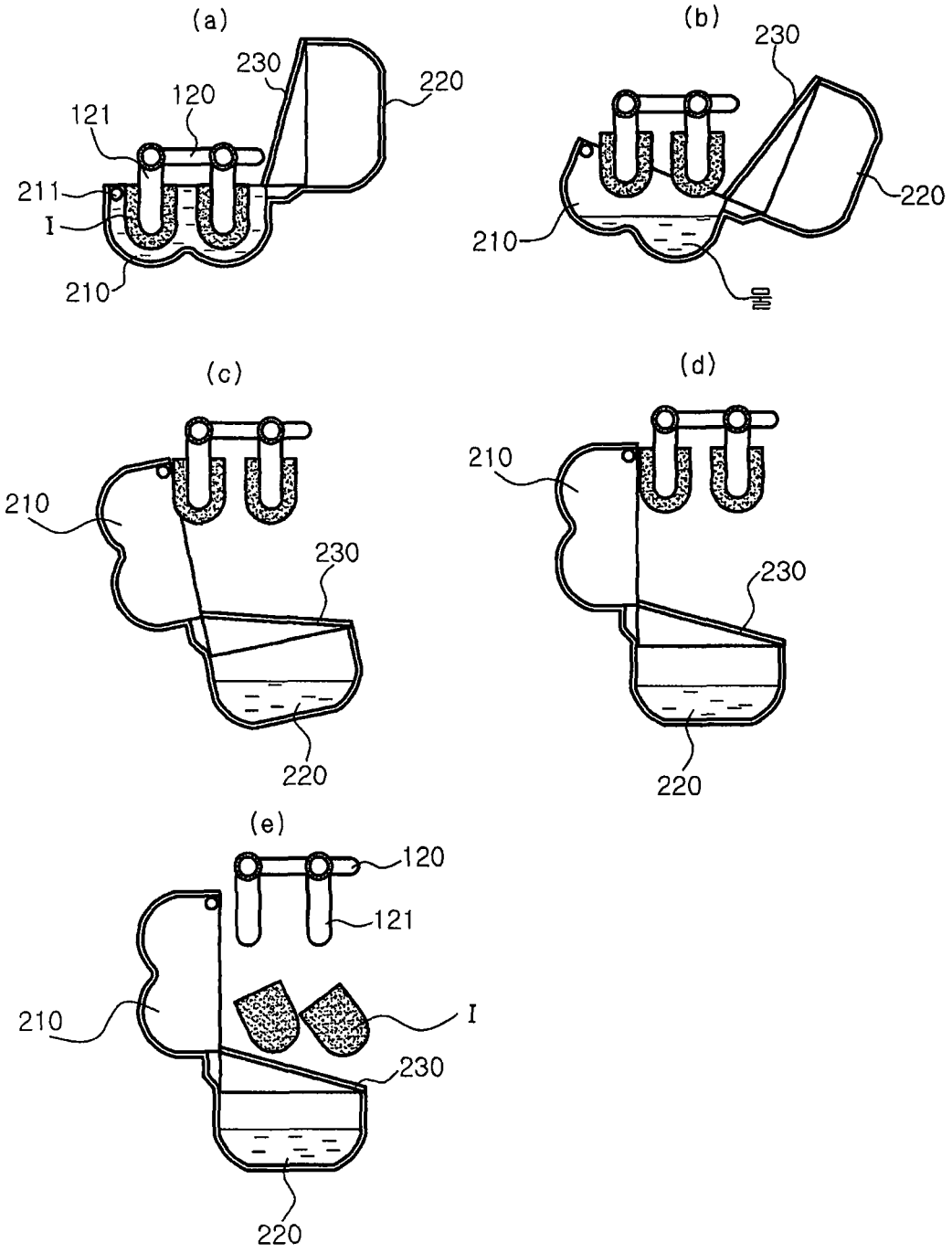
FIG. 5 is a cross-sectional view sequentially illustrating an operating procedure of the water tray member according to one exemplary embodiment of the present invention.
Figure 6:
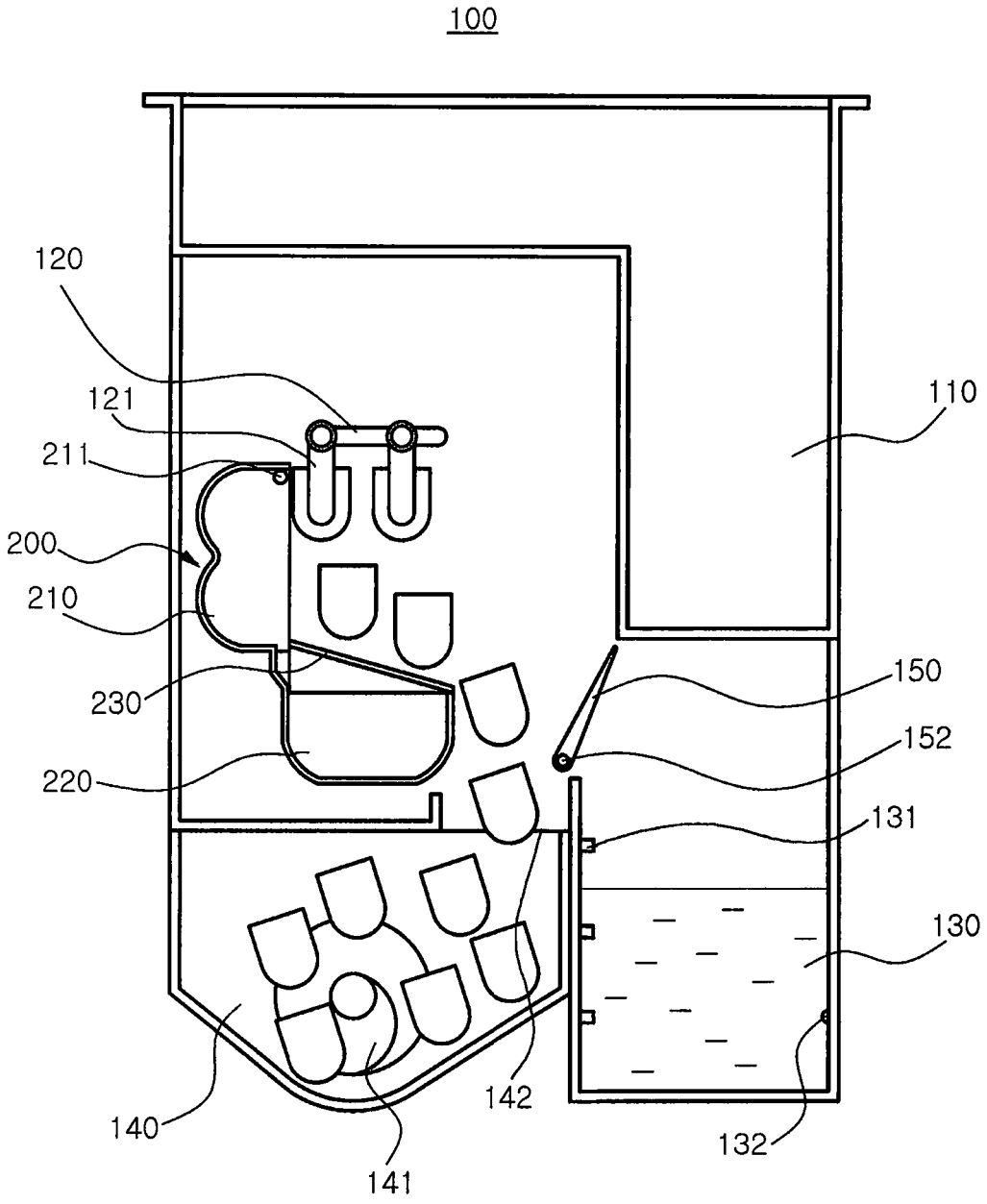
FIG. 6 is a schematic view illustrating that ice is fed to an ice reservoir at an ice separation position of a water tray member.
Figure 7:
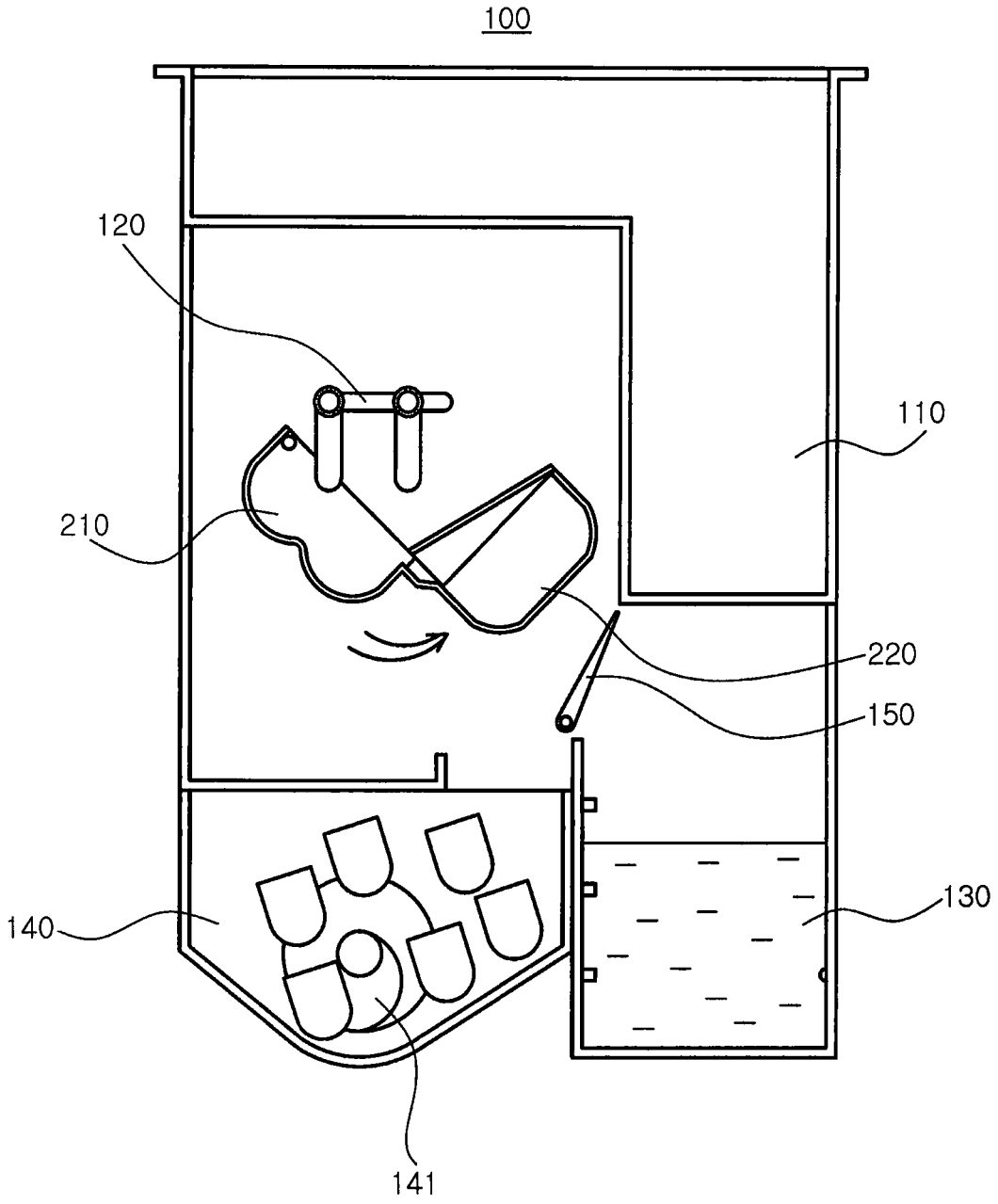
FIG. 7 is a schematic view illustrating that a water tray member returns to an ice-making position.
Figure 8:
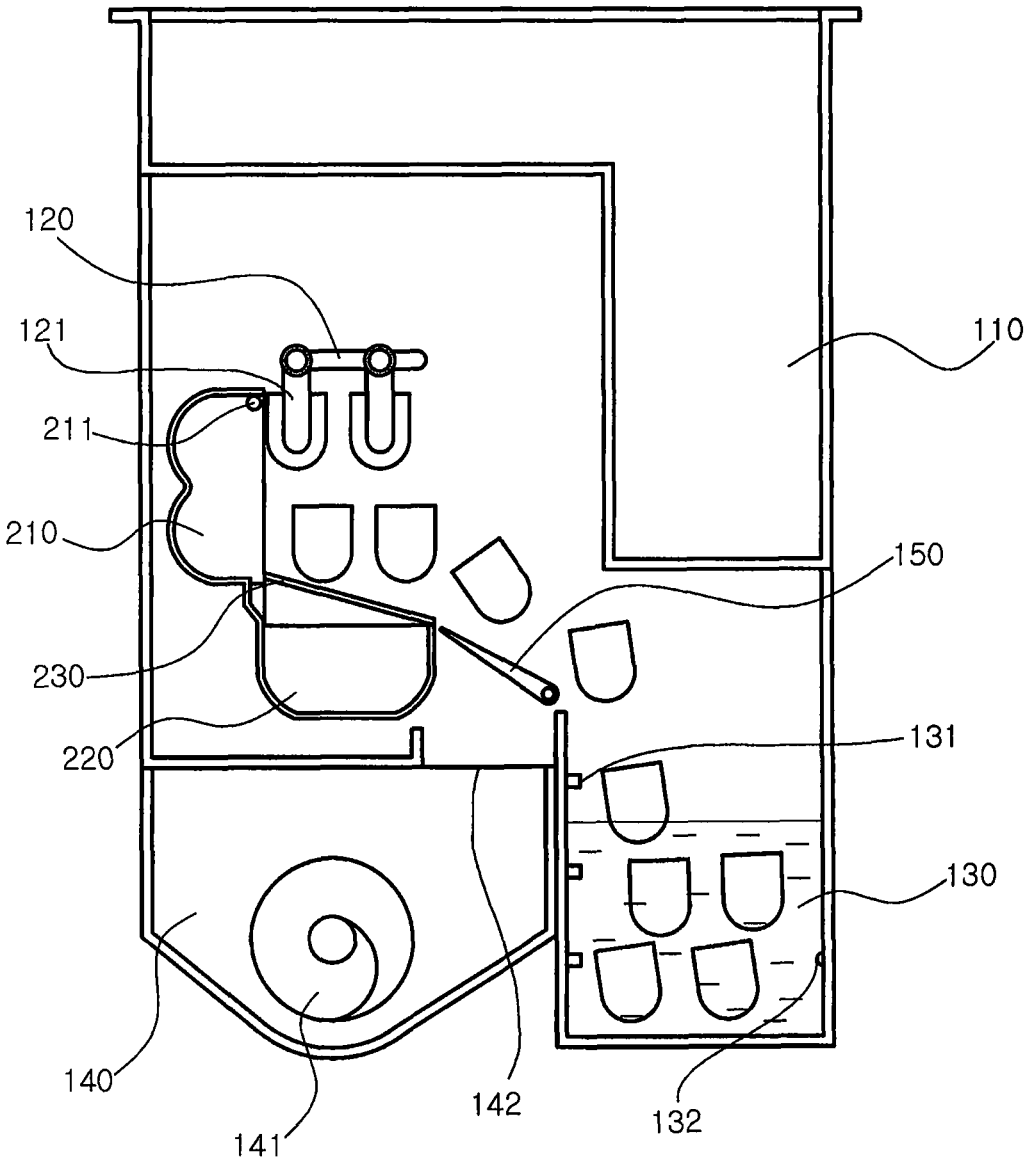
FIG. 8 is a schematic view illustrating that ice is fed to a cold water storage tank according to one exemplary embodiment of the present invention.

FIG. 1 is a partially exploded perspective view illustrating a water purifier having an ice maker according to one exemplary embodiment of the present invention, FIG. 2 is a schematic view illustrating an inner configuration of the water purifier having an ice maker as shown in FIG. 1, FIG. 3 is a perspective view illustrating a water tray member provided in the water purifier having an ice maker according to one exemplary embodiment of the present invention, FIG. 4 is a cross-sectional view illustrating a water tray member as shown in FIG. 3, FIG. 5 is a cross-sectional view sequentially illustrating an operating procedure of the water tray member according to one exemplary embodiment of the present invention, FIG. 6 is a schematic view illustrating that ice is fed to an ice reservoir from an ice separation position of a water tray member, FIG. 7 is a schematic view illustrating that a water tray member returns to an ice-making position, and FIG. 8 is a schematic view illustrating that ice is fed to a cold water storage tank according to one exemplary embodiment of the present invention.

Hereinafter, the ice maker and the water purifier having the same according to one exemplary embodiment of the present invention is described in more detail with reference to FIGS. 1 to 8.

As shown in FIGS. 1 and 2, the ice maker according to one exemplary embodiment of the present invention includes a water tray member 200 holding ice-making raw water; ice-making unit comprising evaporator 120 and compressor (not shown); and ice reservoir 140 storing ice made by means of the ice-making unit. Further, the water purifier 100 having an ice maker according to one exemplary embodiment of the present invention includes a water tray member 200 holding ice-making raw water; an ice reservoir 140 storing ice made in an ice-making unit; a cold water storage tank 130 cooling water held therein using the ice made in the ice-making unit; and a guide member 150 guiding the ice made in the ice-making unit so that the ice can be selectively fed to either the ice reservoir 140 or the cold water storage tank 130.

Referring to FIGS. 1 to 8, the water tray member 200 includes an ice-making water tray 210 holding ice-making raw water to make ice using an ice-making unit; and an auxiliary water tray 220 holding ice-making raw water remaining in the ice-making water tray 210 in the course of cooling the ice-making raw water by means of the ice-making unit and removing the ice-making raw water from the ice-making water tray 210.

The ice-making water tray 210 has a space for holding ice-making raw water in an ice-making position as shown in FIG. 5 (*a*), the space having a predetermined volume to hold ice-making raw water. In this case, the ice-making raw water fed to the ice-making water tray 210 may be fed to a purified water storage tank 110. However, when low-temperature raw water is fed to the purified water storage tank 110, the ice-making efficiency is improved. Therefore, water is more preferably fed from the cold water storage tank 130.

Also, the auxiliary water tray 220 is coupled to one side of the ice-making water tray 210 to receive and hold ice-making raw water remaining in the ice-making water tray 210 in the ice separation course of removing the ice-making raw water from the ice-making water tray 210

In this case, the rotation of the ice-making water tray 210 is performed by a water tray rotating means 180.

More particularly, the ice-making raw water remaining in the ice-making water tray 210 is transferred and held in the auxiliary water tray 220 as the water tray member 200 rotates about the pivot of the water tray rotating shaft 211 by means of the water tray rotating means 180, from an ice-making position as shown in FIG. 5 (*a*) to an ice separation position as shown in FIG. 5 (*d*) and FIG. 5 (*e*). When the ice separation is completed, the water tray member 200 returns to the ice-making position as shown in FIG. 5 (*a*) from the ice separation position as shown in FIG. 5 (*e*) by means of the water tray rotating means 180. In this case, the residual raw water transferred to the auxiliary water tray 220 is fed back to the ice-making water tray 210.

Therefore, when ice is re-made by the ice-making unit, water whose temperature is close to 0° C. (degree Celsius), which remains in the ice-making water tray 210 after the ice-making operation, may be re-used as the ice-making raw water, which leads to improved ice-making efficiency. Meanwhile, ice-making raw water, which runs short due to the ice-making operation, is provided from the cold water storage tank 130 or the purified water storage tank 110, as described above.

In this case, in order to allow the ice-making water tray 210 and the auxiliary water tray 220 to rotate together, the auxiliary water tray 220 is preferably installed in one side of the ice-making water tray 210 so that the auxiliary water tray 220 is fixed and maintained in the ice-making water tray 210.

Also, the ice-making water tray 210 and the auxiliary water tray 220 may be integrally formed as shown in FIG. 3, but also be manufactured and assembled as separate members for convenience's sake.

Although the ice-making unit is not shown in the drawings, a cooling cycle is achieved in the same manner as in the conventional cooling systems. In this case, the ice-making unit used in the present invention may take an immersion-type ice making technique of immersing an immersion pipe 121 provided in a cooling cycle evaporator 120 in ice-making raw water held in the ice-making water tray 210 and cooling the ice-making raw water to make ice around an immersion pipe 121 when the ice-making unit is put into action, but the present invention is not particularly limited thereto. Therefore, a variety of known ice-making/ice separation techniques are applicable to the ice-making unit.

Meanwhile, when the water tray member 200 including the ice-making water tray 210 and the auxiliary water tray 220 moves from an ice-making position to an ice separation position, a rotation angle of the water tray member 200 rotated by the water tray rotating means 180 is preferably in a range of 80 to 120 degrees. In case the rotation angle of the water tray member 200 is less than 80 degrees, the ice, which is separated from the immersion pipe 121 during the ice separation, interferes with the water tray member 200 not to move to a desired position. On the contrary, when the rotation angle of the water tray member 200 exceeds 120 degrees, the transfer of the ice-making raw water between the ice-making water tray 210 and the auxiliary water tray 220 does not go on easily during the rotation of the water tray member 200, or water may flow over the outside of the auxiliary water tray 220. Preferably, the ice-making water tray 210 is at right angle to the auxiliary water tray 220, and a rotation angle of the water tray member 200 may be 90 degrees, as shown in FIGS. 1 to 8.

As shown in FIGS. 1 and 2, the ice reservoir 140 is installed in a lower position than the water tray member 200 so that the ice reservoir 140 can hold ice separated from the ice-making unit.

In this case, an ice discharge unit 141 such as a screw may be installed in the ice reservoir 140 so as to discharge ice. When the ice discharge unit 141 rotates about the pivot of the rotation axis 141*a*, the ice is discharged from the ice reservoir 140. This internal configuration of the ice reservoir 140 has been widely used in the conventional ice makers and water purifiers having an ice maker. Therefore, detailed descriptions of the internal configuration of the ice reservoir 140 are omitted for clarity.

Also, the cold water storage tank 130 is configured so that water held in the cold water storage tank 130 can be cooled with the ice made at the ice-making unit. Here, a plurality of water level sensors (i.e. a full water level sensor 131) and a temperature sensor 132 are installed in the cold water storage tank 130 to adjust a water level and temperature of water in the cold water storage tank 130.

Meanwhile, the water tray member 200 may further include a guide grill 230 mounted on the auxiliary water tray 220. In this case, the guide grill 230 is provided with a water inlet 231 having a smaller diameter than that of the ice so that the ice-making raw water remaining in the ice-making water tray 210 can flow in the auxiliary water tray 220 and the ice can fall down into the ice reservoir 140 or the cold water storage tank 130 in the ice separation course of removing ice-making raw water from the ice-making water tray 210.

Also, when the water tray member 200 rotates towards an ice separation position by means of the water tray rotating means 180, the guide grill 230 is preferably inclined downwards along a direction where the ice falls down at the ice separation position so that the guide grill 230 can guide ice to the ice reservoir 140 or the cold water storage tank 130.

In addition, the guide member 150 guides separated ice so that the separated ice can be selectively transferred to the ice reservoir 140 and the cold water storage tank 130.

Such a guide member 150 may rotate between a first position to which the ice made by the ice-making unit is guided so that the ice is fed to the ice reservoir 140 (see FIG. 6), and a second position to which the cold water is guided so that the ice is fed to the cold water storage tank 130 (see FIG. 8). Here, the guide member 150 rotates about the pivot of the rotation axis 152 by means of rotary drive means (not shown).

Since the ice is selectively fed to either the ice reservoir 140 or the cold water storage tank 130 by the rotation of the guide member 150, the water purifier has an advantage in that the feeding of the ice is simply carried out.

Meanwhile, the water purifier 100 having an ice maker according to one exemplary embodiment of the present invention may further include a controller (not shown) controlling the ice-making unit, the water tray member 200, the guide member 150 and the like, depending on the temperature of water in the cold water storage tank 130 that is sensed by a temperature sensor 132.

Such a controller may be configured so that the controller can control an amount of ice fed to the cold water storage tank 130 according to the temperature of water in the cold water storage tank 130.

For example, when a temperature of water in the cold water storage tank 130 is higher than a set temperature, a large amount of ice may flow in the water storage tank 130 under the control of the controller. In this case, the guide member 150 moves to a position to which the ice is guided so that the ice can flow in the cold water storage tank 130 (see FIG. 8).

In case the temperature of water in the cold water storage tank 130 is slightly higher than the set temperature, it is unnecessary to feed a large amount of the ice to the cold water storage tank 130. Therefore, a small amount of ice preferably flows in the cold water storage tank 130. For this purpose, the controller may control the ice separation when small-sized ice is being formed around the immersion pipe 121 of the ice-making evaporator 120, that is, before ice is formed into a full size.

According to such a configuration of the controller, the temperature of water in the cold water storage tank 130 may be maintained to an adequate level using the ice transferred to the cold water storage tank 130.

An operation of the water tray member 200 is described in more detail with reference to FIG. 5.

FIG. 5 (*a*) shows an ice-making position of the water tray member 200. As shown in FIG. 5 (*a*), ice-making raw water flows and is held in the ice-making water tray 210 during the initial ice-making process. Such ice-making raw water may be fed from the cold water storage tank 130 or the purified water storage tank 110. Then, the immersion pipe 121 of the evaporator 120 is immersed in the ice-making raw water and cooled in this ice-making position.

When the ice-making operation is completed, the water tray member 200 rotate clockwise by means of the water tray rotating means 180, as shown in FIG. 5 (*b*).

When the water tray member 200 rotates further as shown in FIG. 5 (*c*), the ice-making raw water remaining in the ice-making water tray 210 is passed through the water inlet 231 of the guide grill 230, and completely transferred and held in the auxiliary water tray 220.

FIG. 5 (*d*) shows the complete rotation of the water tray member 200 toward the ice separation position.

When hot gas is supplied to the immersion pipe 121 of the evaporator 120 in this ice separation position, as shown in FIG. 5 (*e*), the formed ice (I) is separated by the heat derived from the hot gas. In this case, the separated ice falls along an inclined surface of the guide grill 230, and is transferred to either the cold water storage tank 130 or the ice reservoir 140, depending on the position of the guide member 150.

Then, when the water tray member 200 returns to an ice-making position as shown in FIG. 5 (*a*) in order to perform the next ice-making operation, the cold ice-making raw water remaining in the auxiliary water tray 220 is passed through the water inlet 231 of the guide grill 230, and fed back to the ice-making water tray 210 during this operation. In this case, in order to fill up the lacking ice-making raw water, additional water is fed from the cold water storage tank 130 or the purified water storage tank 110.

As described above, the ice maker and the water purifier having the same according to one exemplary embodiment of the present invention has an advantage in that the ice-making efficiency is improved since the cooling water whose temperature is close to 0° C. (degree Celsius), which is cooled and remains in the ice-making water tray 210, may be re-used through the auxiliary water tray 220 to make ice. Further, the ice maker and the water purifier having the same according to one exemplary embodiment of the present invention has a beneficial effect in performing an effective ice-making operation although a temperature of water in the cold water storage tank 130 is increased due to the dispensing of excessive cold water since the cooling water which is cooled and remains in the ice-making water tray 210 may be re-used in the next cooling procedure.

Then, a procedure of feeding ice to the ice reservoir 140 or the cold water storage tank 130 is described in more detail with reference to FIGS. 6, 7 and 8.

The procedures of making and separating ice using the rotation of the water tray member 200 are described as shown in FIG. 5. In order to feed ice to the ice reservoir 140, it is necessary that the guide member 150 rotates toward a position where it guides ice to the ice reservoir 140 as shown in FIG. 6 during the ice separation.

In this case, the ice separated from the immersion pipe 121 falls along an inclined surface of the guide grill 230 which is inclined downwards at the ice separation position, and is guided by the guide member 150 to the ice reservoir 140 via the ice input port 142.

Then, another ice-making operation is initiated by rotating the auxiliary water tray 220 toward the ice-making position, as shown in FIG. 7.

Meanwhile, when it is necessary to cool the cold water storage tank 130 due to the increased temperature of water in the cold water storage tank 130, ice is fed to the cold water storage tank 130. That is, the guide member 150 rotates toward a position where it guides ice to the cold water storage tank 130, as shown in FIG. 8, and feeds the ice made and separated from the ice-making unit to the cold water storage tank 130.

In this case, an amount of the ice fed to the cold water storage tank 130 is controlled by a controller, depending on the temperature of water in the cold water storage tank 130.

As described above, a separate evaporator is not required to cool the cold water storage tank 130 since the ice made in the ice-making unit is used to cool water held in the cold water storage tank 130. Therefore, the water purifier 100 having an ice according to one exemplary embodiment of the present invention may have simple configuration of a cooling cycle.

Also, the water purifier 100 having an ice according to one exemplary embodiment of the present invention may maintain the temperature of water in the cold water storage tank 130 to an adequate level since water purifier 100 is provided with a controller controlling an amount of ice fed to the cold water storage tank 130 according to the temperature of water in the cold water storage tank 130.

The exemplary embodiments of the present invention have been described in detail with reference to the accompanying drawings. However, it should be understood that the detailed description and specific examples, while indicating exemplary embodiments of the invention, are given by way of illustration only, since various changes and modifications within the scope of the invention will become apparent to those skilled in the art from this detailed description.

What is claimed is:

1. A water purifier having an ice maker, comprising:

a water tray member comprising an ice-making water tray holding ice-making raw water to make ice using an ice-making unit, and an auxiliary water tray holding ice-making raw water remaining in the ice-making water tray in the course of cooling the ice-making raw water by means of the ice-making unit and removing the ice-making raw water from the ice-making water tray;

an ice reservoir storing ice made in the ice-making unit;

a cold water storage tank cooling water held therein using only the ice made in the ice-making unit and provided to the cold water storage tank; and a guide member guiding the ice made in the ice-making unit so that the ice is selectively fed to either the ice reservoir or the cold water storage tank, wherein the guide member rotates between a first position to which the ice is guided so that the ice is fed only to the ice reservoir and a second position to which the ice is guided so that the ice is fed only to the cold water storage tank, the auxiliary water tray is coupled to one side of the ice-making tray to rotate with the ice-making water tray, the ice-making raw water remaining in the ice-making water tray is transferred to the auxiliary water tray only by the rotation of the ice-making water tray toward an ice separation position by means of a water tray rotating means, the residual raw water transferred to the auxiliary water tray is fed back to the ice-making water tray only by the rotation of the ice-making water tray to return to an ice-making position by means of the water tray rotating means, and the auxiliary water tray has a shape and size similar to the ice-making water tray.

2. The water purifier of claim 1, wherein the water tray member further comprises a guide grill provided with a water inlet having a smaller diameter than that of the ice so that the ice-making raw water remaining in the ice-making water tray flows in the auxiliary water tray, the guide grill being mounted on the auxiliary water tray.

3. The water purifier of claim 2, wherein the guide grill is inclined downward to the ice reservoir or the cold water storage tank at the ice separation position.

4. The water purifier of claim 1, further comprising a controller controlling an amount of ice being fed to the cold water storage tank according to the temperature of water in the cold water storage tank.

* * * * *